US007850398B2

(12) United States Patent
Foo et al.

(10) Patent No.: US 7,850,398 B2
(45) Date of Patent: Dec. 14, 2010

(54) JACKUP OIL RIG AND SIMILAR PLATFORMS

(75) Inventors: Kok Seng Foo, Singapore (SG); Margarita Ivanova Georgieva, Singapore (SG); Chin Kau Quah, Singapore (SG)

(73) Assignee: Offshore Technology Development Pte Ltd, Singapore (SG)

( * ) Notice: Subject to any disclaimer, the term of this patent is extended or adjusted under 35 U.S.C. 154(b) by 547 days.

(21) Appl. No.: 11/764,235

(22) Filed: Jun. 18, 2007

(65) Prior Publication Data

US 2007/0243024 A1 Oct. 18, 2007

Related U.S. Application Data

(63) Continuation of application No. 11/014,822, filed on Dec. 20, 2004, now abandoned.

(30) Foreign Application Priority Data

Sep. 7, 2004 (SG) ..... 200404950-8

(51) Int. Cl.
*E02B 17/02* (2006.01)
*B63B 35/44* (2006.01)

(52) U.S. Cl. ..... 405/212; 405/198; 405/203; 405/217; 405/228; 114/40; 114/265

(58) Field of Classification Search ..... 405/196, 405/211–217, 198; 114/40, 264, 265
See application file for complete search history.

(56) References Cited

U.S. PATENT DOCUMENTS

| | | | | | |
|---|---|---|---|---|---|
| 2,589,146 | A | * | 3/1952 | Samuelson | 405/208 |
| RE24,180 | E | * | 7/1956 | Parks | 405/205 |
| 2,877,629 | A | * | 3/1959 | De Long et al. | 405/198 |
| 2,938,353 | A | * | 5/1960 | Vorenkamp | 405/207 |
| 2,976,693 | A | * | 3/1961 | Showalter et al. | 405/201 |
| 3,312,295 | A | * | 4/1967 | Bodine, Jr. | 175/19 |
| 3,353,362 | A | * | 11/1967 | Lubinski | 405/228 |
| 3,717,001 | A | * | 2/1973 | Tam | 405/210 |
| 3,950,954 | A | * | 4/1976 | Haug | 405/228 |
| 4,046,657 | A | * | 9/1977 | Abbott | 204/515 |
| 4,069,681 | A | * | 1/1978 | Mott | 405/226 |
| 4,161,376 | A | * | 7/1979 | Armstong | 405/196 |
| 4,311,415 | A | * | 1/1982 | Christenson | 204/515 |
| 4,408,932 | A | * | 10/1983 | Cowan | 405/227 |
| 4,445,807 | A | * | 5/1984 | Cowan | 405/227 |
| 4,451,174 | A | * | 5/1984 | Wetmore | 405/196 |
| 4,762,442 | A | * | 8/1988 | Thomas et al. | 405/196 |
| 4,890,959 | A | * | 1/1990 | Robishaw et al. | 405/204 |
| 4,913,591 | A | * | 4/1990 | Steele | 405/196 |
| 5,012,875 | A | * | 5/1991 | Casbarian et al. | 175/9 |
| 5,188,484 | A | * | 2/1993 | White | 405/198 |
| 5,551,801 | A | * | 9/1996 | Gallaher et al. | 405/204 |
| 5,725,329 | A | * | 3/1998 | Chelminski | 405/232 |
| 2006/0062636 | A1 | * | 3/2006 | Bennett et al. | 405/198 |

* cited by examiner

*Primary Examiner*—Tara Mayo-Pinnock
(74) *Attorney, Agent, or Firm*—Pyprus Pte Ltd

(57) ABSTRACT

A jackup rig having a built-in capability of driving and extracting piles without need for dedicated pile drivers or extractors. The jackup rig provides an ice breaking functional capability, supplied by a jacking system, for operating in icy waters.

7 Claims, 10 Drawing Sheets

JACKUP OIL RIG AND SIMILAR PLATFORMS

CROSS-REFERENCE TO RELATED APPLICATION

This application is a continuation of application Ser. No. 11/014,822 filed Dec. 20, 2004, now abandoned now US Publication No. 2006/0051164A1, published on Mar. 9, 2006.

FIELD OF THE INVENTION

The present invention relates to self-elevating or jackup oil rigs and similar platforms.

In particular, this invention relates to a method and system for jackup oil rigs and similar platforms to allow them to be used in more severe environments than prior oil rigs, such as bodies of water with thin surface ice.

More particularly, this invention relates to a method and system utilizing the built-in jackup capabilities of such platforms to drive piles into the seabed to anchor the jackup oil rig or similar platforms without the need for dedicated pile drivers. This will reduce the initial and recurrent costs of operating such rigs.

Another aspect of the present invention extends the built-in jackup capability of such rigs in the breakup of ice formation around the rig in cold operating environments.

BACKGROUND OF THE INVENTION

Oil rigs are offshore structures that are used to extract petroleum and other naturally-formed hydrocarbon deposits (eg natural gas) from the seabed. However, many oil fields are found in inhospitable locations. These locations may have extreme environmental conditions such as storms and ice at certain times of the year.

To maximize their output or productivity, oil rigs are operated for as long as possible in the window of opportunity afforded by the milder months. This window may be as short as three months in the higher latitudes. When the environmental conditions change for the worse, these rigs may be temporarily abandoned or if they are mobile, displaced to another safer location.

To enable such mobility, oil rigs may be self-propelled or may be towed to the desired site, and anchored. The means of anchoring are well known in the art. These may include legs that reach to the seabed enabled by jacking systems such as in U.S. Pat. No. 6,076,996 and in the oil rigs designed and built by the applicant of the present invention (U.S. Pat. No. 6,030,149). Alternatively, oil rigs may be submersible or semi-submersible by having ballast tanks that may be flooded to anchor the oil rig as exemplified by U.S. Pat. No. 5,292,207.

Besides having to be securely anchored during use, there is the danger posed by ice formations to oil rigs in arctic conditions. Currently, icebreaker ships may be employed to break up ice formation around an oil rig to prevent the ice build-up from damaging the rig. In the case of U.S. Pat. No. 5,292,207 or U.S. Pat. No. 6,371,695, the rigs may possess built-in means or provide a crush-resistant structure against encroaching ice, obviating the need for icebreaker ships.

These built-in ice breaking means are usually heavily sloped plates or plates installed around the support legs of a rig. The idea behind such inventions is that by flexing the ice will cause it to fracture. Thus, as the ice sheet is formed and moves against the rig, the ice sheets slide up the slope of the plate. As the angle of the slope is sharp, the rigid ice sheet does not bend and instead fractures. As such, damage from ice sheets building up around the supporting leg is prevented. In another invention, U.S. Pat. No. 4,102,144, the ice breaking means is raised along the supporting leg to break the ice. The shield may be heated to melt ice pieces adhering to it, dislodging them.

These inventions show that means to anchor an oil rig or similar structure are important, as are means to prevent damage from ice build-up.

Therefore, there is a continued need for means to allow an oil rig or similar structure to operate in harsher environments such as rough seas or icy conditions to tap the hydrocarbon reservoirs in these regions. An invention that can withstand such conditions will extend the window of operation for oil rigs, increase the production capacity while reducing costs, and hence improve the profitability of the rig. Such an invention will be welcome in the industry.

SUMMARY OF THE INVENTION

The present invention discloses, in a first aspect, a method for driving piles for a jackup rig, the jackup rig comprising a jackup hull, a mat and at least one leg, the method comprising:

a. installing a piling sub-system on the rig; the piling sub-system comprising a plurality of piles, each pile with at least one collars, each collar with a locking means;
b. moving the rig to a desired location;
c. raising the jackup hull with the piling sub-system unlocked;
d. locking the locking means for at least one pile;
e. lowering the jackup hull a predetermined distance, thereby driving in the at least one pile into the seabed;
f. unlocking the locking means for the at least one pile;
g. raising the jackup hull by another predetermined distance, leaving the at least one pile unmoved;
h. repeating steps d to g until the pile is driven to a desired depth; and
i. repeating steps c to h until the desired number of piles is driven into place, thereby utilizing the built-in jackup capability of the rig to obviate the need for a dedicated pile driver.

The invention also seeks to provide, in a second aspect, a method for extracting piles for a jackup rig, the jackup rig comprising a jackup hull, a mat and at least one leg, the method comprising:

a. installing a piling sub-system on the rig; the piling sub-system comprising a plurality of piles, each pile with at least one collars, each collar with a locking means;
b. lowering the jackup hull a first predetermined distance with the piling sub-system unlocked;
c. locking the locking means for at least one pile;
d. raising the jackup hull a second predetermined distance, thereby extracting in the at least one pile from the seabed;
e. unlocking the locking means for the at least one pile;
f. lowering the jackup hull by another predetermined distance, leaving the at least one pile unmoved;
g. repeating steps c to g until the pile is extracted; and
h repeating steps b to g until a desired number of piles are extracted, thereby utilizing the built-in jackup capability of the rig to obviate the need for a dedicated pile extractor.

The present invention also seeks to provide, in a third aspect, a jackup oil rig possessing a pile driving and extracting capability, the pile driving and extracting capability comprising a piling sub-system; the piling sub-system further comprising:

at least one collar;

at least one locking means;

at least one pile;

wherein the at least one collar, the at least one locking means and the at least one pile work in conjunction with the jackup oil rig to drive and extract the at least one pile without the need for a dedicated pile driver or extractor.

BRIEF DESCRIPTION OF THE DRAWINGS

A preferred embodiment of the present invention will now be more fully described, by way of example, with reference to the drawings of which:

FIG. 2A illustrates the collar and locking means for the piles while

DETAILED DESCRIPTION OF THE DRAWINGS

In accordance with the detailed descriptions, a preferred embodiment of the invention is described, together with a few variations to illustrate the versatility of the invention. In the following description, details are provided to describe the preferred embodiment. It shall be apparent to one skilled in the art, however, that the invention may be practiced without such details. Some of these details may not be described at length so as not to obscure the invention.

There are many advantages of the preferred embodiment of the invention. One advantage of the preferred embodiment is that it is resistant against the impact of ice. Another advantage is that additional supports for a jackup oil rig in the form of piles may be driven in place and subsequently extracted without the need for a dedicated pile driver or winch.

Another advantage is that ice formation around such rigs or similar platforms may be broken up using novel and inventive means based on the built-in jackup capability of such rigs and platforms.

Referring now to FIG. 1, the method of putting an oil rig of the prior art into operation is described. Such an oil rig is exemplified by a model designed and built by the applicant of the present invention.

Figure 1A:
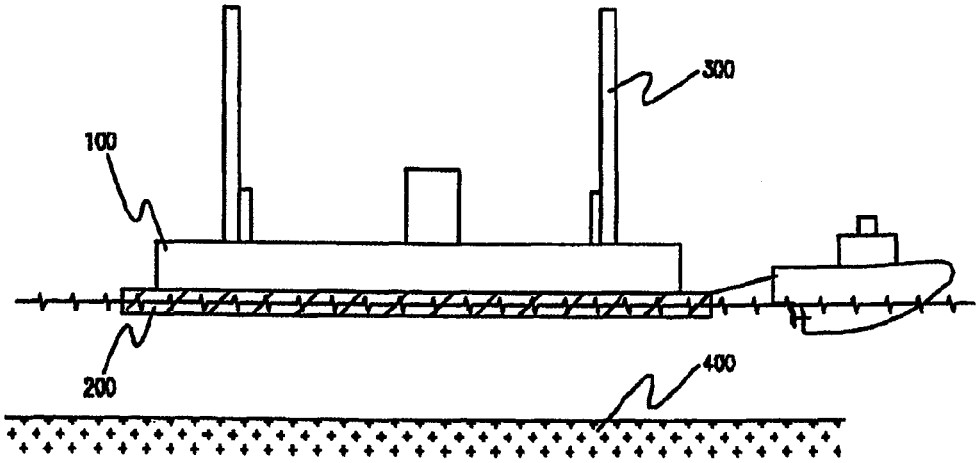
FIG. 1A (Prior Art)
FIGS. 1A-C illustrate a method by which a jackup rig of a prior is put into place.
Figure 1B:
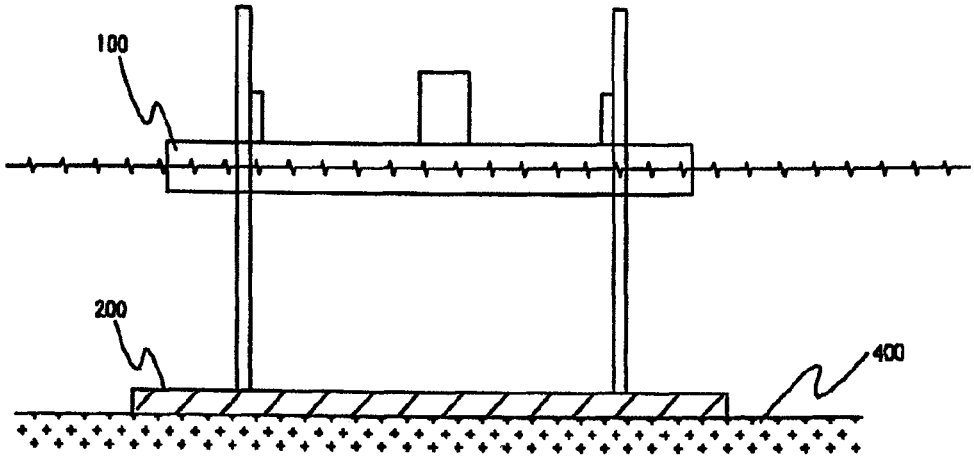
FIG. 1B (Prior Art)

Such an oil rig is first moved into position by one or more barges (FIG. 1A). The oil rig comprises an jackup hull 100 connected to a lower structure, a buoyant watertight mat 200, by one or more legs 300. When in position, ballast tanks in the mat are flooded and the mat sinks until it reaches the seabed 400 (FIG. 1B).

Figure 1C:
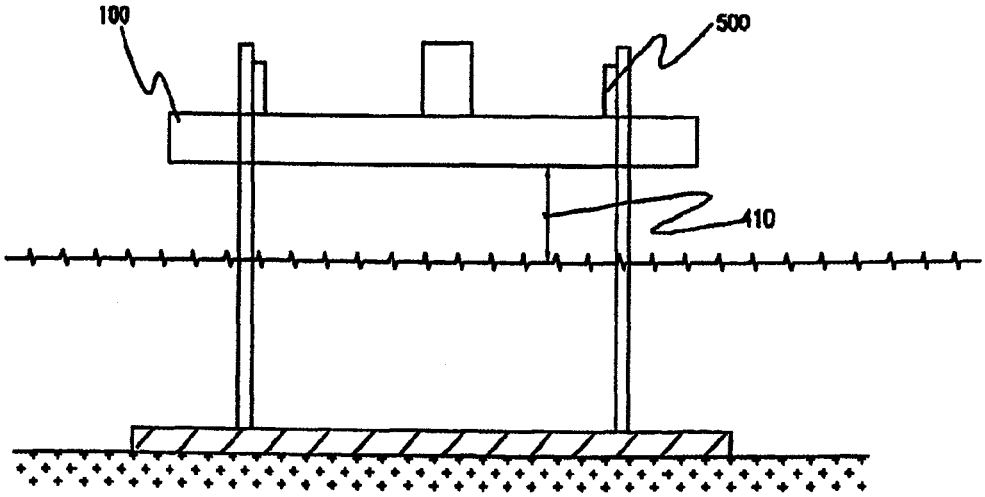
FIG. 1C (Prior Art)

Thereafter, the rig's built-in jacking system, itself comprising of complementary jackup modules 500 of elevating units of jacks and locks working in unison, is used to raise the jackup hull 100 above sea level for a predetermined distance (FIG. 1C). This may be done in one continuous operation or a series of operations until an air gap 410 is achieved. The air gap is the height or distance of the bottom of the jackup hull above sea level.

Figure 1D:
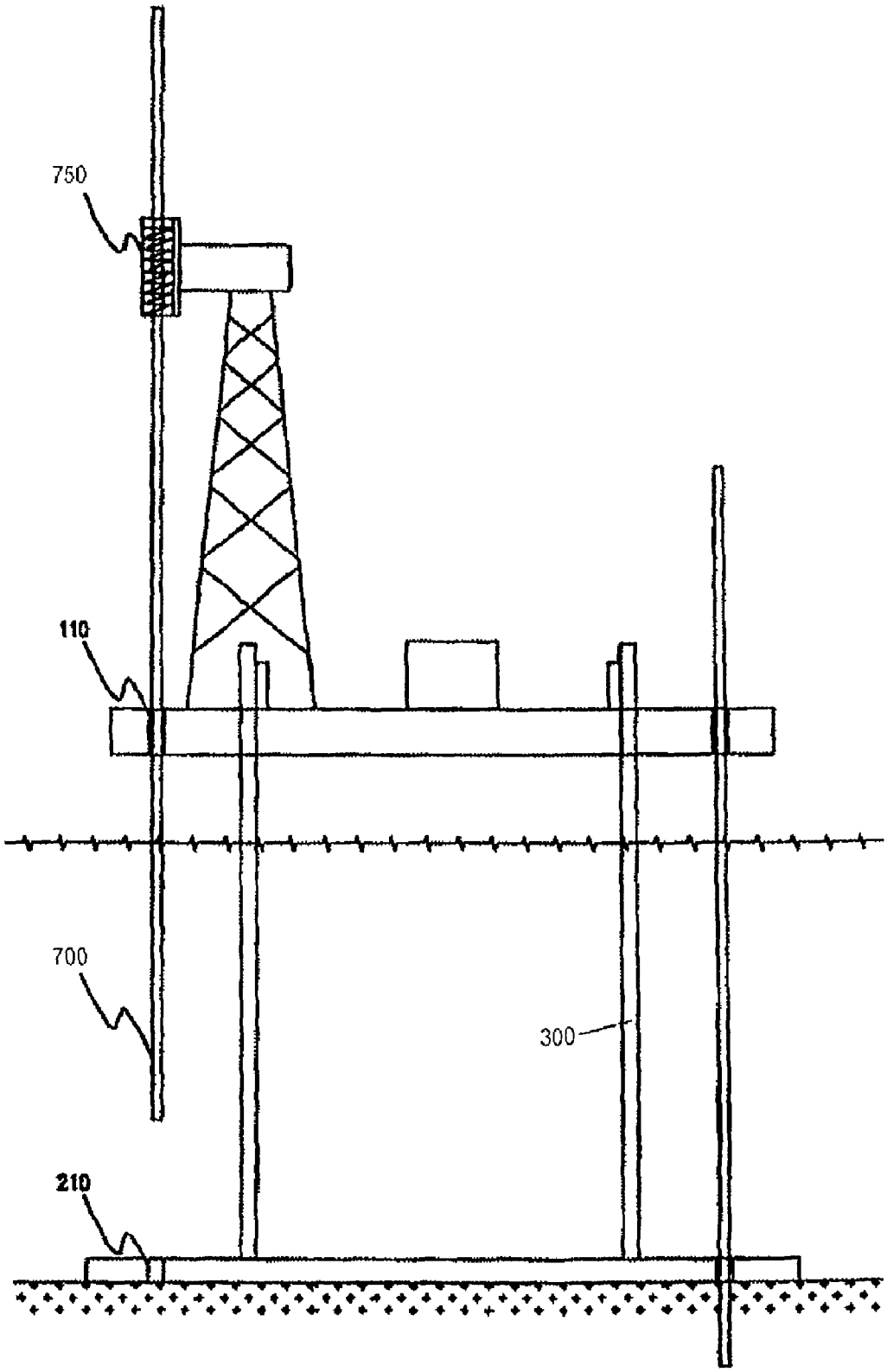
FIG. 1D (Prior Art)
FIG. 1D illustrates another method by which legs and piles of a jackup oil rig of a prior art are put into place.

The oil rig is now largely ready to begin actual drilling operations with the volume of water in the mat acting as ballast to anchor and stabilize the rig. However, it may be desirable, for example, in rough seas, to have additional supports comprising piles 700 driven into the seabed to further anchor the oil rig (FIG. 1D). Under the prior art, this is done erecting a dedicated pile driver 750 to drive the piles into the seabed 400. When it is time to displace the oil rig, a winch or vibratory pile extractor (such as those manufactured by the International Construction Equipment company) is needed to remove the piles from the seabed.

Under the present invention, a novel and inventive method is taught whereby use of a dedicated pile driver and pile extractor is obviated. The system of the present invention is a jackup oil rig or similar structure possessing the capability and means described and practicing the invention according to the methods as taught below.

In the present invention, the mass and jacking system of the oil rig are used to drive in the piles. To extract the piles, the jacking system and the buoyancy of the rig is used. As the jacking system is already part of a jackup rig's built-in machinery, no additional cost for a dedicated pile driver or extractor are needed. This cuts costs significantly as, in the prior art, the dedicated pile driver and extractor are only needed at the beginning and end of a rig's operational period at any particular site. While such rig is in operation, the pile driver and extractor remain essentially idle and does not contribute to productivity while contributing to the cost of the rig.

Figure 2A:
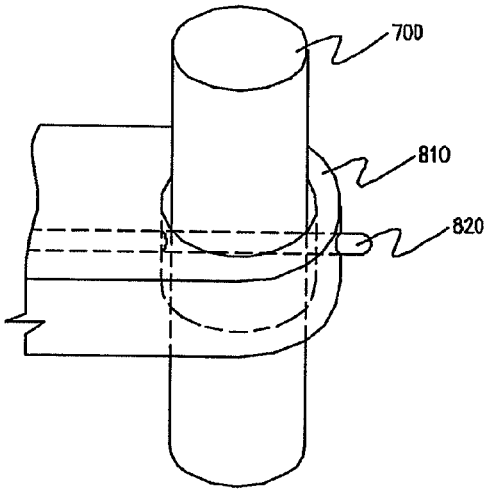

The only additional features required to practice the invention are the installation of a piling sub-system 800 comprising collars 810 (FIG. 2A) that align and guide the piles and locking means that work in conjunction with the collars to engage and grip the piles during insertion and extraction, and the piles 700 to be driven in. These features are in addition to the supporting legs 300 and jackup modules 500 already present in a jackup rig. At least one such collar 810 with its accompanying locking means, here shown as a pin 820 as an example, is used for each pile 700 to be driven in (FIG. 2A). The locking means comprises at least one pin driven to engage or withdraw from a complementary recess in the pile. These complementary recesses are found at intervals along each pile.

Figure 2B:
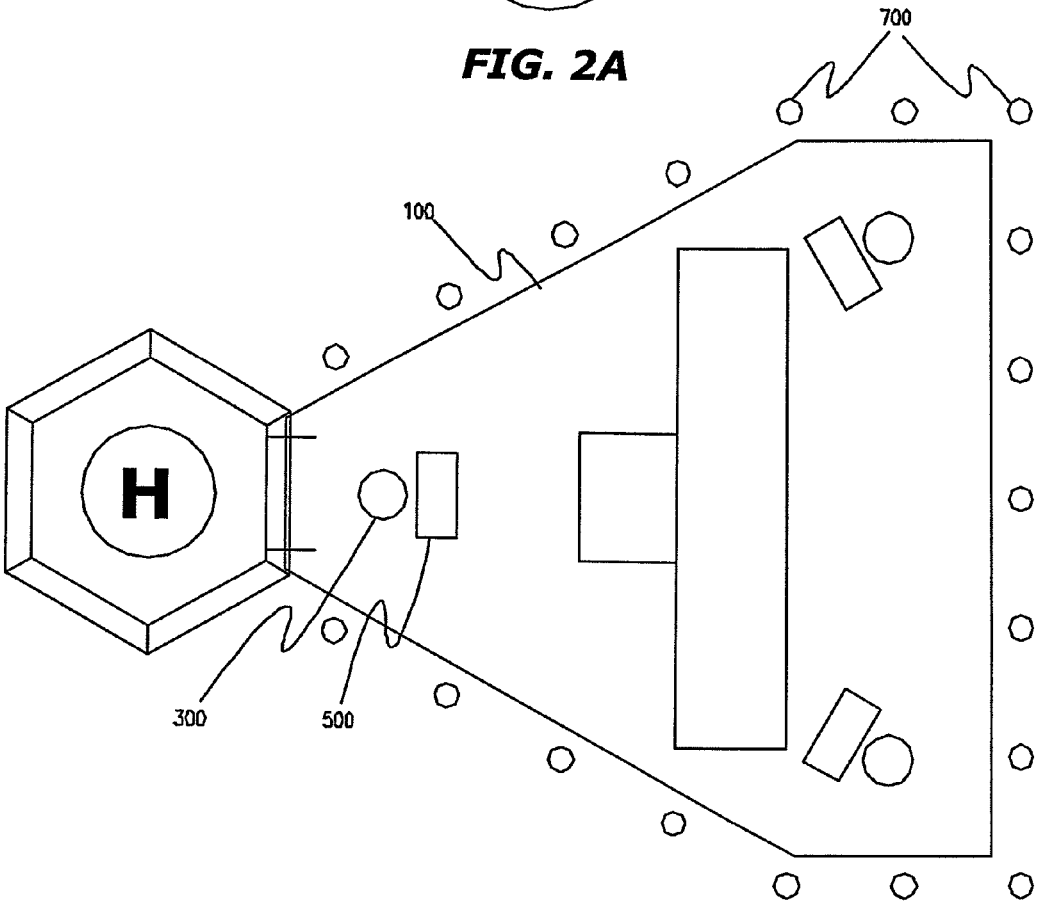
FIG. 2B is the plan view of an oil rig showing the disposition of the piles around the perimeter of an oil rig with a triangular configuration.

As an example, for an oil rig of a triangular configuration of 240 ft length by 220 ft width, eight to 10 piles 700 evenly disposed around the perimeter of the oil rig is recommended (FIG. 2B). This is only an illustration and the number and disposition of the collars and piles may be varied according to the configuration of the rig and the conditions under which they operate.

The collars and locking means may be readily retrofitted into existing oil rigs or included in the constructions of new ones. If desired, the piles may also be further supported by guides or bores 210 built into the mat such that the alignment of the pile to be substantially perpendicular to the horizontal plane of the mat 200 or jackup hull 100 is assured (FIG. 1D).

FIG. 3 shows how piles are driven in by the method of the present invention. The oil rig of the present invention is first moved into position (FIG. 3A). On the rig are elements of the piling sub-system 800 (comprising a plurality of the collars and locking means) and piles 700 previously described. The lower ends of the piles are substantially flushed with the bottom of the mat.

The mat 200 is then lowered (FIG. 3B) by blowing its ballast tanks and letting in water until the mat rests on the seabed. The jackup hull 100 remains at the level of the water surface as it is buoyant. As the locking means are not engaged, friction with the bores 110, 210 and their own mass allow the piles 700 to be brought down with the lowering of the mat to the seabed 400. The arrows in the figures indicate the movement of the piles.

The rig or structure's jacking system is then engaged to raise the jackup hull 100 (FIG. 3C) to a predetermined height above the level of the water. It may be seen that the lower ends of the piles remain in contact with the seabed 400 during this operation as the piles are not being gripped or engaged by the locking means 800. As such, they slide freely within the collars 810, and the bores 110, 220 as the jackup hull is raised.

Thereafter, depending on capability of the jacking system, the number of piles present, and the type and condition of soil in the seabed, one or more piles may be locked by their respective locking means 800 in preparation for being driven into the seabed.

The jacking system is then engaged in the reverse direction to lower the jackup hull 100 (FIG. 3D), driving any piles 700 that are locked into the seabed 400 a predetermined distance. A person skilled in the art will appreciate that in this driving operation, both the jacking force generated by the jacking system and the mass of the jackup hull are harnessed to drive in the pile. This total force of the jackup system alone may be as high as 46,800 kips for the rig example cited and is considerably greater than that generated by most pile marine pile drivers in use. A person skilled in the art will appreciate that the number of piles that may be driven in simultaneously depends on a variety of factors such as the mass of the jackup hull, the power of the jacking system, and the seabed conditions.

Figure 3A:
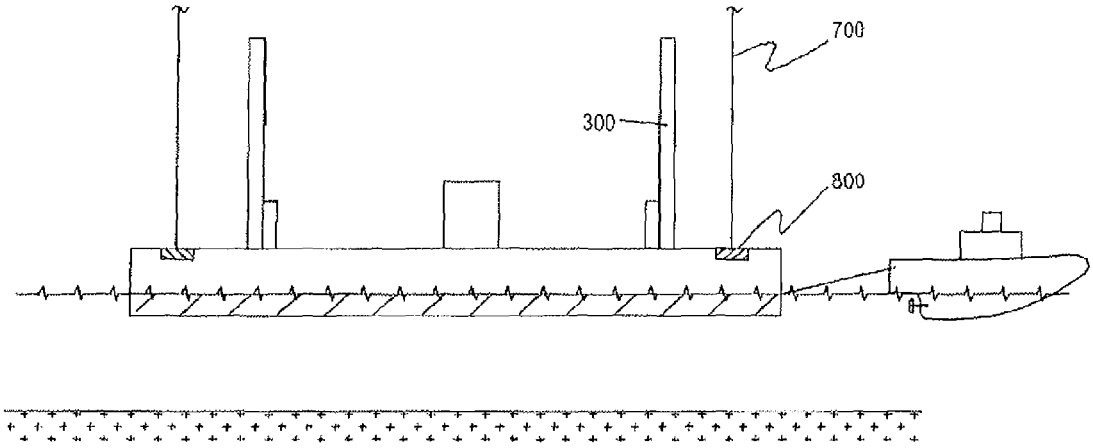
FIGS. 3A-F illustrate a sequence by which piles are driven by the method of one embodiment of the present invention.
Figure 3B:
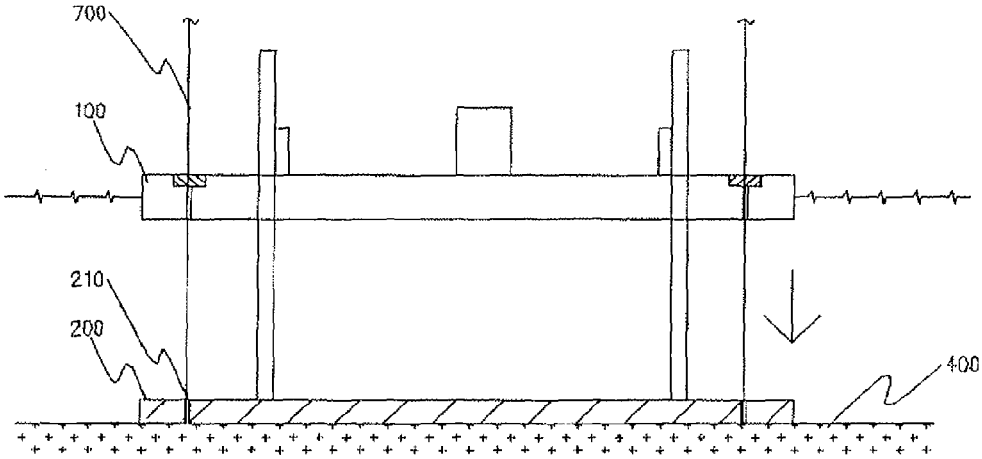
Figure 3C:
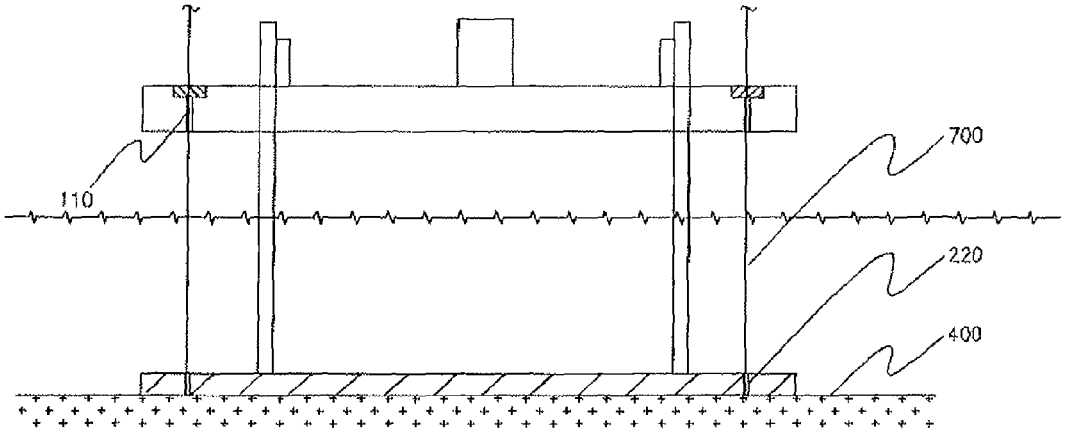
Figure 3D:
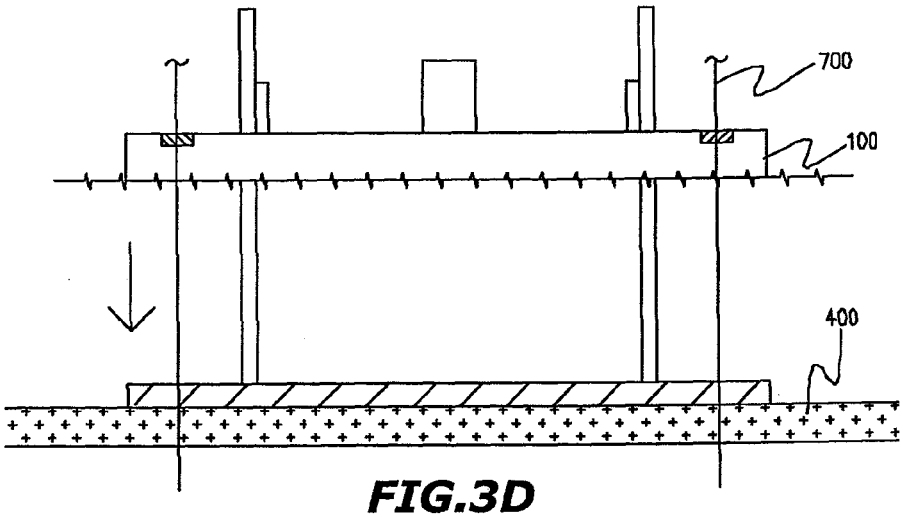
Figure 3E:
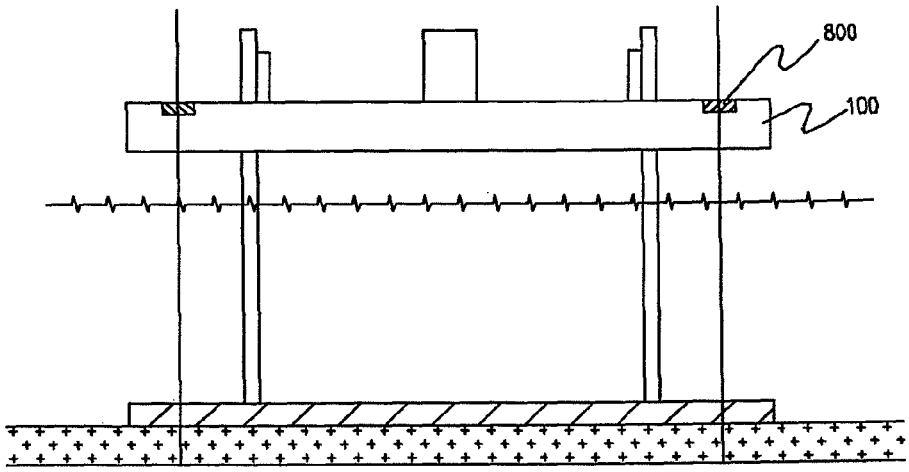

Once a pile is driven in, the jackup hull 100 is then jacked up again with the locking means 800 released or disengaged, allowing the collars to freely slide up the piles, leaving the piles that were just driven in position, unmoved (FIG. 3E).

The locking means for the pile just driven in may be re-engaged and the hull lowered again to further drive in the pile until the appropriate depth is desired. A person skilled in the art of pile driving will appreciate that this operation may be repeated as many times as necessary until the pile has been driven to the desired depth. A person skilled in the art will also appreciate that, with the present invention, a number of piles may be simultaneously driven in to save time and cost. This is a huge increase in efficiency over the use of a pile driver to sequentially drive in the piles one by one. When driving in multiple piles at the same time, it is apparent to one skilled in the art that it will be best to drive in the piles such that the total force generated (jacking force and mass of the hull) be evenly and symmetrically distributed to the piles being driven. For example, piles at the apices of an oil rig with a triangular configuration may be driven in at the same time.

Figure 3F:
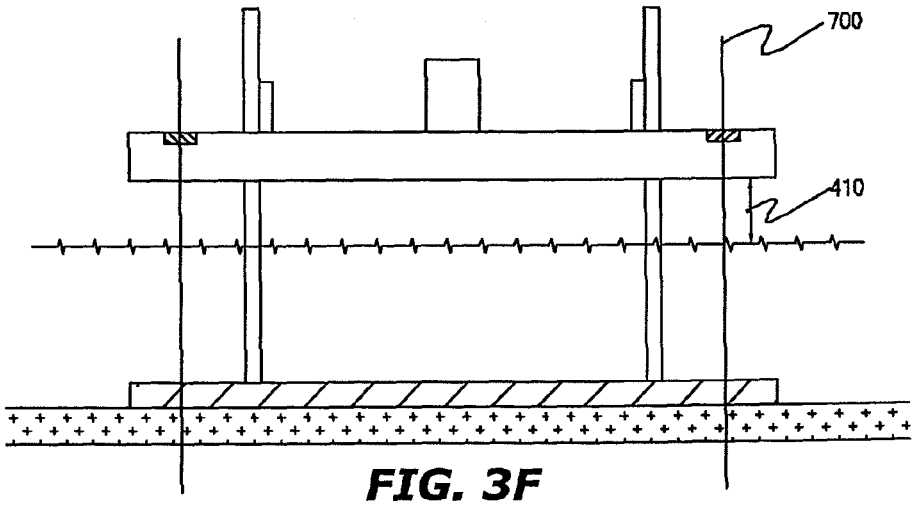

Once the last pile has been driven in, the hull is then raised to the desired height above the sea level (air gap 410) and the oil rig can then begin its drilling and extraction operations (FIG. 3F).

When it is time to displace the rig due to avoid extreme conditions, or when the location has been exhausted of its hydrocarbon deposits, the present invention may be used to extract the piles without the need for a dedicated extractor or winch. It will be apparent to one skilled in the art that reversing the process of driving in the piles will extract the piles, except that now, it is the buoyancy, not the mass, of the jackup hull, that work in conjunction with the jackup system in this extraction operation.

Figure 4A:
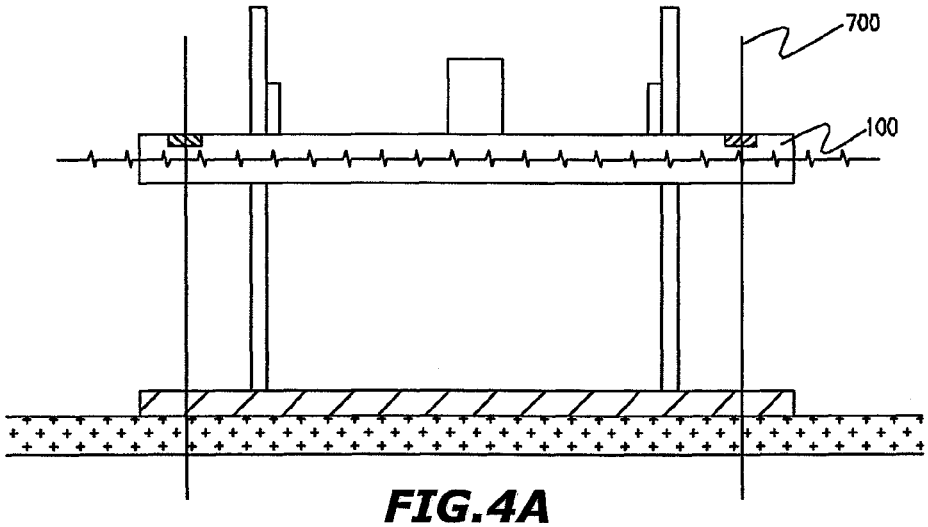
FIG. 4A-C illustrates a sequence by which the piles are extracted by the method of another embodiment of the present invention.
Figure 4B:
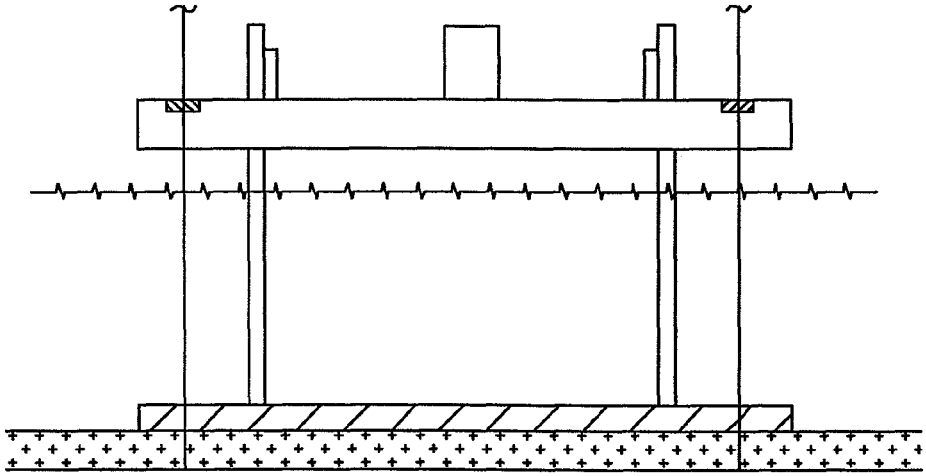

As shown in FIG. 4A, the locking means 800 for all the piles 700 are released. The jackup system is then engaged in reverse to lower the jackup hull 100, preferentially until part of it is below the waterline. In most rigs, the jackup hull is watertight and is thus positively buoyant. Thereafter, the locking means for one or more piles to be extracted are engaged and the hull jacked up to a predetermined height (FIG. 4B). The raising of the hull will pull up any engaged piles and the buoyancy of the hull is tapped to assist in the extraction of the piles.

Figure 4C:
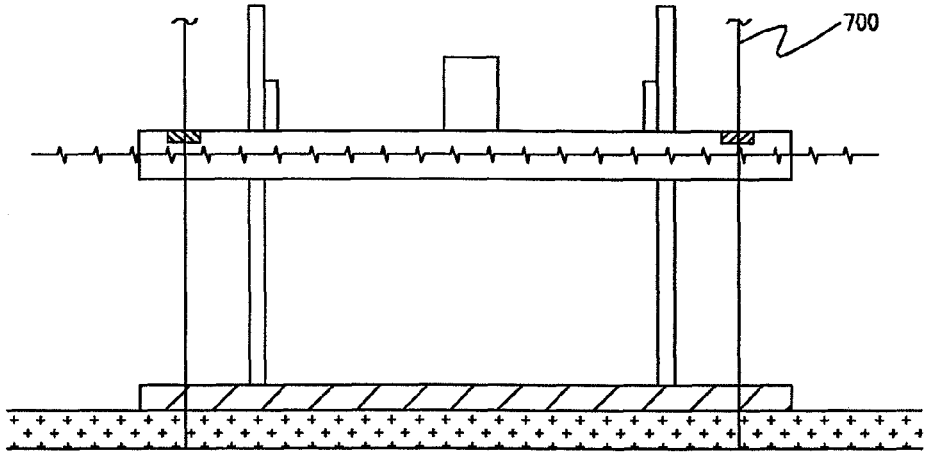
Figure 5A:
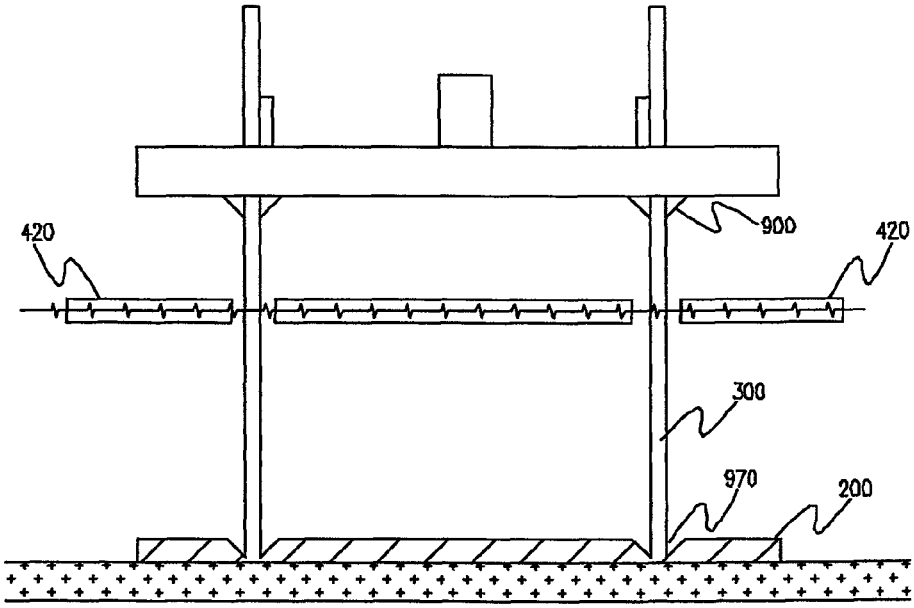
FIGS. 5A and 5B illustrate a jackup rig embodied with an ice breaking structure in accordance with one embodiment of the present invention.
Figure 5B:
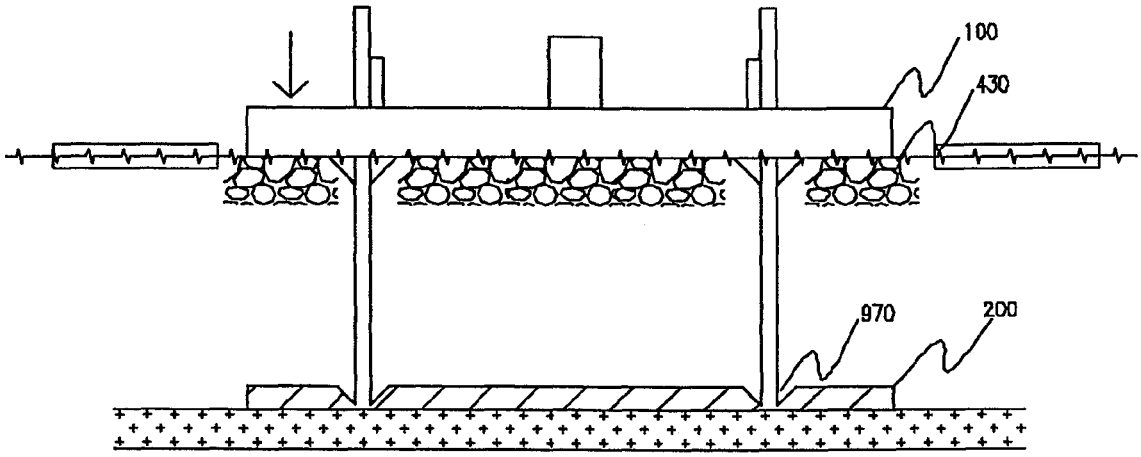
Figure 6A:
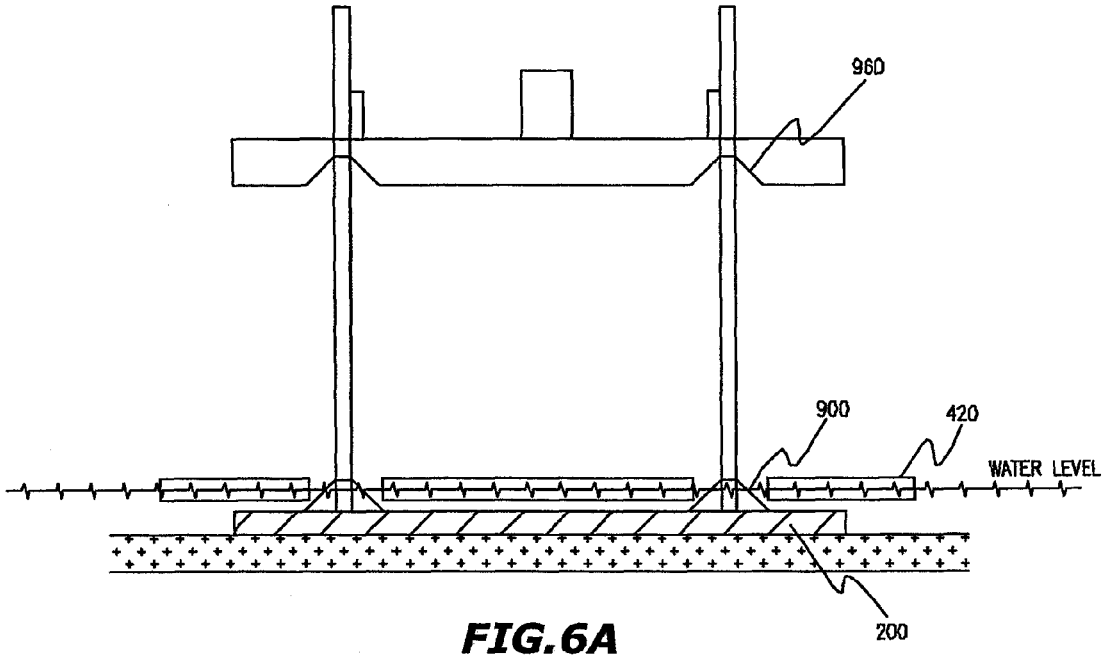
FIGS. 6A and 6B illustrate a jackup rig embodied with an ice breaking structure in accordance with another embodiment of the present invention.
Figure 6B:
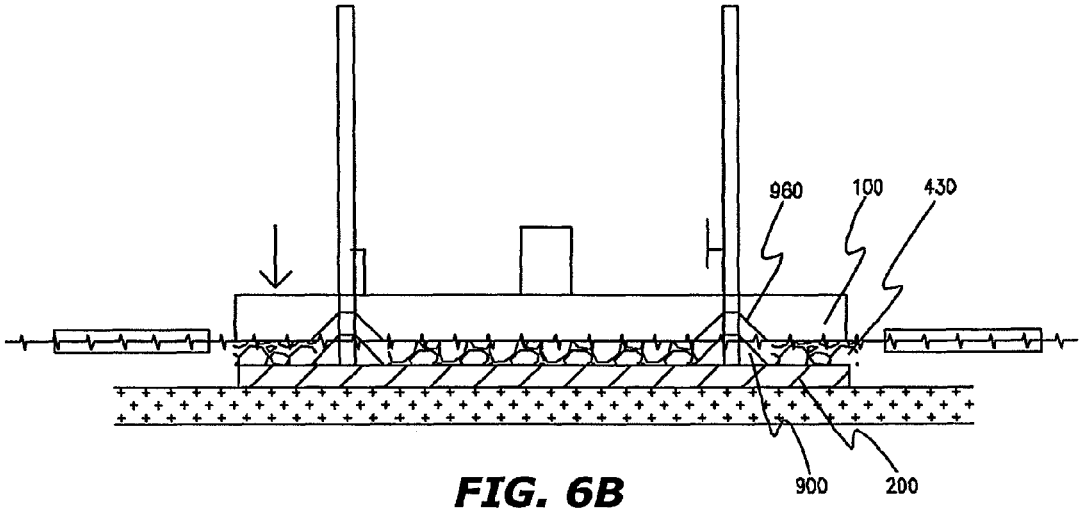

The locking means that were engaged are now released and the hull lowered again (FIG. 4C). Then the locking means for the partially extracted piles 700 are re-engaged and the hull raised. This operation is repeated until the all the piles are extracted. Even if the hull is not buoyant, the considerable force generated by the jacking system itself is greater than that of a winch or vibratory extractor. As such, multiple piles may be extracted simultaneously instead of sequentially as with technology of the prior art. This saves time and cost for the installation or rental of a dedicated extractor.

It will be appreciated that the sequence of operations (locking and unlocking the piles, raising and lowering the jackup hull, etc) may be done manually or automatically. The degree of automation desired may be obtained by installing a suitable control sub-system to coordinate the locking and unlocking of the locking means with the jackup operation. A person skilled in the art will appreciate that such a control sub-system may be readily implemented and as such, details of this control sub-system is not described so as not to obscure the invention.

Also, the operation of the locking means may be powered by any suitable means of motive force, such as those supplied by electrical, mechanical, electromechanical, hydraulic or pneumatic means. Such motive means and control sub-systems come under the scope of the present invention.

It will be apparent to a person skilled in the art that variations to the guiding of the piles may be done while keeping within the scope and spirit of the invention. For example, we have described and illustrated that the piles are already in place in their collars at the start of the driving operation. It is clear that the piles need not be pre-positioned and may also be inserted into place after the rig has arrived and the mat lowered into position. Such preparatory details are not essential in this invention. What is essential is the idea to use the built-in capabilities of the jacking system of a jackup rig to replace a dedicated pile driver and extractor. This extended use of the jackup system and capability of jackup rigs and similar structures are hitherto untapped in rigs of the prior art.

The present invention also provides for a method and system to break up ice formation around the rig using the jackup system of the rig; it maximizes the capabilities of the jackup system, thereby extending the useful operating window of the rig in icy or arctic conditions.

The ice breaking means of the present invention is a heavy three-dimensional metal structure, preferably resembling a three-dimensional heavily-sloped trapezoidal or pyramidal structure 900 with sharp corners (FIGS. 5, 6, 7 and 8). The ice breaking means is also preferentially disposed circumferentially around, or near the legs 300 of the jackup rig. This is because ice sheets 420 pose great risk to the legs of an oil rig.

The ice breaking means may be located on the underside of the jackup hull 100 (FIG. 5) or on the upper surface of the mat 200 (FIG. 6), depending on the depth of water the rig is operating in. In very shallow water, the ice breaking means may be arranged on the mat such that the ice breaking means is at or near the surface of the water where the ice sheets will form.

To break up forming ice sheets 420, the jackup system of the present invention is engaged to lower the upper hull 100 until the lower surface of the upper hull forces against the ice sheets. Regardless of whether the ice breaking means 900 is located on the underside of the upper hull (FIG. 5) or on the upper surface of the mat (FIG. 6), the mass and shape of the ice breaking means, the mass of the upper hull and the power of the jackup system, provide sufficient force to fracture the ice 430 (FIGS. 5B and 6B; arrows indicate the direction of movement of the jackup hull).

It is clear that an ice breaking means with sharp corners will be better at fracturing the ice although smooth rounded shapes will also work. To facilitate the housing of the ice breaking means while the rig is in transit, corresponding recesses 960, 970 may be constructed in the opposing surface to contain the ice breaking means.

Figure 7A:
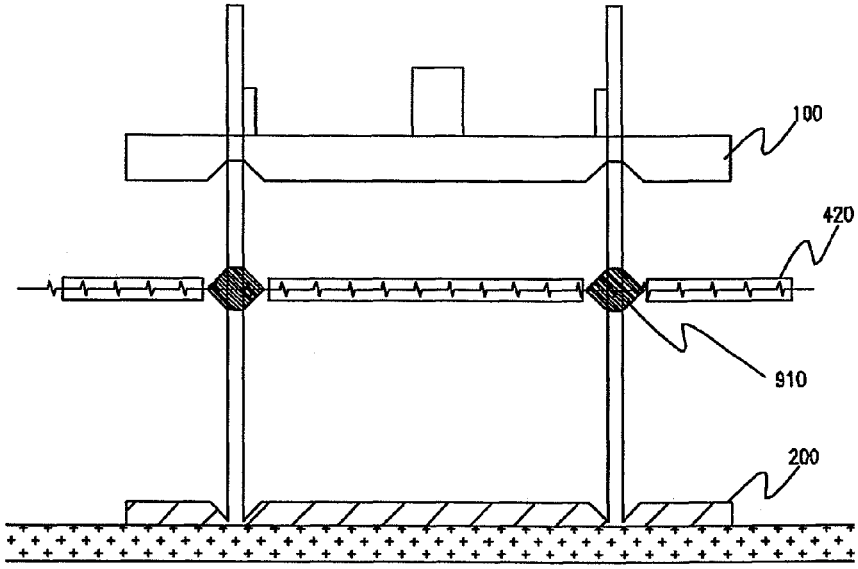
FIGS. 7A and 7B illustrate a jackup rig embodied with an ice breaking structure in accordance with yet another embodiment of the present invention.
Figure 7B:
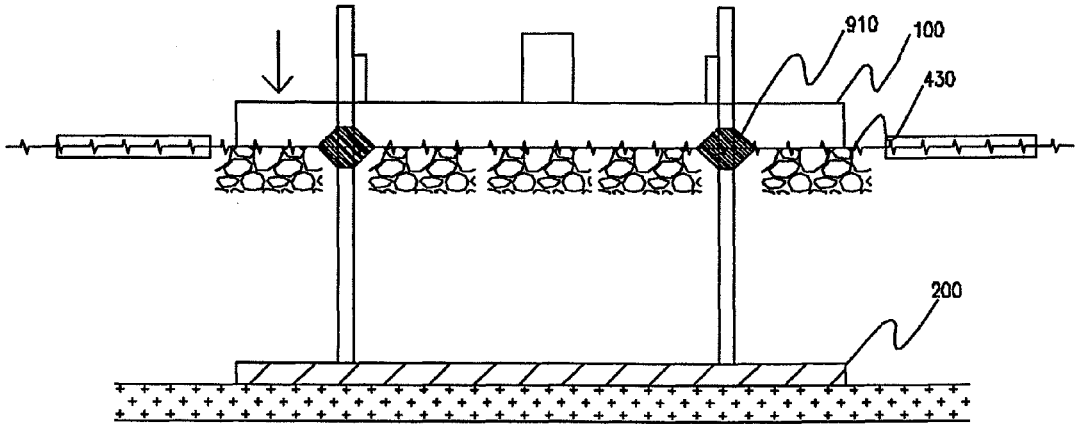

It can be seen that the breaking of ice in the present invention is to use the jackup system of the oil rig to move the jackup hull 100 against a fixed structure such as the mat 200 or the ice breaking means 900. As such, in another embodiment (FIG. 7), the ice breaking means 910 may be fixed around each supporting leg of the rig, at the surface of the water. As the jackup hull 100 is lowered, ice 430 is broken by being sandwiched between the jackup hull 100 and the ice breaking means 910 (FIG. 7B).

Unlike the ice breaking method of U.S. Pat. No. 4,102,144, wherein the ice breaking shield is raised to break ice, the ice breaking means in yet another embodiment (FIG. 8) of the present invention can break ice when it is both raised or lowered, as it is sloped on both the upper 930 and lower 940 surfaces, making it more efficient than that of the prior art.

Figure 8A:
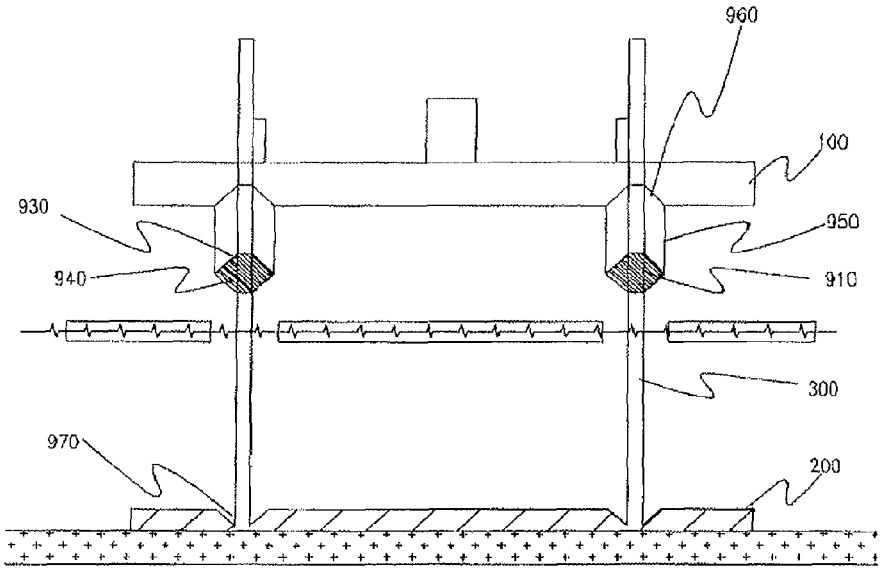
FIGS. 8A and 8B illustrate a jackup rig embodied with an ice breaking structure in accordance with yet another embodiment of the present invention

In this embodiment, the ice breaking means 910, being heavy, is held by a suspension means 950 such as chains or ropes to the underside of the upper hull, and is preferentially disposed around or near each supporting leg 300 of the rig (FIG. 8A).

Referring again to FIG. 8A, the length of the suspension means 950 supporting the ice breaking means is adjusted after the oil rig is deployed and operational so that the ice breaking means is held at a "resting" position. This resting position is near (above or below), or at the waterline. As ice sheets build up, raising or lowering the ice breaking structure 910 will break the ice sheets 430.

Figure 8B:
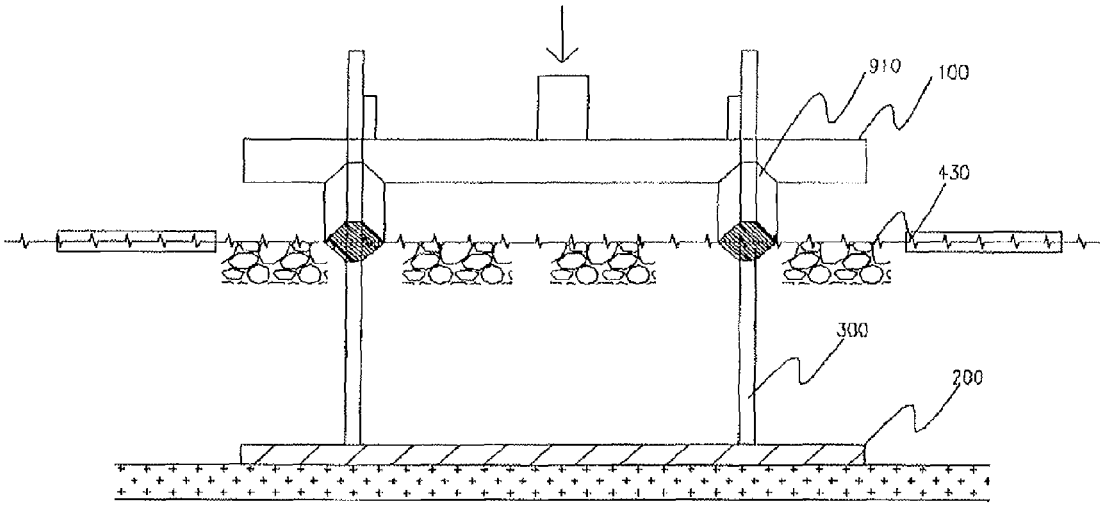

If the ice breaking structure was "resting" above the waterline (FIG. 8A), lowering it a short distance will fracture ice sheets 430 that are building up below it (FIG. 8B). Conversely, a person skilled in the art will appreciate that if the ice breaking means is suspended above the waterline, lowering it (by lowering the entire jackup hull) will break the ice. Unlike the other ice breaking embodiments of the present invention, the mass of the upper hull is not used. Rather, the ice breaking means relies on its own mass to break the ice when it is lowered with the lowering of the jackup hull 100.

Also unlike the prior art, the suspension means 950 is not involved in the raising or lowering of the ice breaking means but rather, it is merely to maintain the ice breaking means at the desired resting position.

This resting position is a matter of choice. If the ice breaking means is held just under the surface of the water, the raising of the ice breaking means will utilize both the power of the jackup system and the shape of the ice breaking means to perform this function. As such, this embodiment (FIG. 8) works when the ice breaking means is raised or lowered. In addition, by the ice breaking means being suspended, the distance by which the upper hull has to be moved is reduced. This aspect of the present invention essentially improves the efficiency of breaking ice by over one fold over methods of the prior art in an inventive and non-obvious way.

This method is non-obvious as prior art inventions such as U.S. Pat. No. 4,102,144 are shaped and configured to break ice only when the ice breaking means is raised. That invention does not perform its function when lowered to its "resting position".

Again, as with the other embodiments, concave recesses 960, 970 in the jackup hull 100 and mat 200 respectively (see example in FIG. 8) receive the ice breaking structure in a stowed position during transit.

A person skilled in the art will appreciate that unlike the first embodiment of the ice breaking means, the means do not necessarily have to move along the supporting legs. They merely need to be affixed to either the bottom of the jackup hull or the top of the mat and the complementary recesses 960, 970 are provided to receive the ice breaking structures during transit.

It will be appreciated that the sequence of operations (monitoring of the ice build-up and the raising and lowering the ice breaking means, etc) may be done manually or automatically. The degree of automation desired may be obtained by the installation of a suitable control system.

Additionally, the driving of the various mechanical aspects of the present invention (eg locking means, adjustment of the suspension means of the ice breaking means, etc) may be obtained by suitable electrical, pneumatic, hydro-pneumatic or hydraulic actuators and devices. A person skilled in the art will appreciate that such devices are easily implemented. As such, further description of such devices is not provided so as not to obscure the invention.

The present invention therefore provides, in one aspect, a method of driving and extracting piles for a jackup rig and similar structures without the need for dedicated pile drivers or extractors. In another aspect, the present invention is a jackup oil rig or similar structures possessing capability afforded by the elements and features described for driving and extracting piles, and practicing the methods taught.

In yet another aspect, the present invention provides a jackup oil rig or similar structure with an ice breaking capability exemplified by the several embodiments of a novel and innovative built-in ice protection means taught.

It is apparent to one skilled in the art that, while the ice breaking aspect of the present invention are described, such ice breaking means are not necessary for practicing the invention of driving and extracting piles in warmer waters where there is no danger from ice sheets.

While the present description is for an oil rig, it is apparent to one skilled in the art, that the present invention may be applied to structures similar to jackup oil rigs such as geological survey vessels and wreck recovery ships. Additionally, while a marine oil rig is described, oil rigs and similar structures used for other bodies of water (eg lakes, rivers, etc) also come within the scope and spirit of the present invention.

It will be appreciated that although only a few preferred embodiments have been described in detail, various modifications and improvements can be made by a person skilled in the art without departing from the scope of the present invention.

The present invention is novel and inventive as there is nothing in the prior art to suggest the use of jackup systems in an oil rig or similar platforms, to drive and extract piles, or to break up ice formation. Jackup oil rigs and similar platforms have always used separate means such as pile drivers and extractors for piles and separate ice-breaking means to handle ice sheets. It is clear that, with this application, the invention is non-obvious, even to persons skilled in the art.

The invention claimed is:

1. A jackup oil rig comprising:

a hull as a working platform;

a plurality of jackup modules being disposed on the hull;

a buoyant mat being rested on the seabed when the jackup oil rig is in operation;

a plurality of legs coupling the hull and buoyant mat, wherein one end of each of the plurality of legs is fixed onto the buoyant mat, and the remaining is operably engaged with the hull; thereby when the legs are disengaged, they move freely through the hull; and when the legs are locked, they are engaged with hull maintaining the distance between the hull and the buoyant mat; wherein each of the plurality of legs is coupled with at least one of the plurality of jackup modules, thereby the hull is driven up and down along the legs by the jackup modules;

a plurality of sloped, trapezoidal or pyramidal structures being attached to the underside of the hull for breaking ice formation around the legs; wherein the plurality of the sloped, trapezoidal or pyramidal structures is disposed circumferentially around the legs; thereby when the hull is jacked down by the jackup module, the sloped, trapezoidal or pyramidal structures break the ice formation around the legs; wherein the upper surface of the buoyant mat around the legs has a recess that is complementary to the sloped, trapezoidal or pyramidal structures for receiving the sloped, trapezoidal or pyramidal structures during operation and storage; and a plurality of piles slidably attached to the hull, wherein when they are driven into seabed, they provide additional support of the hull, and wherein each of the plurality of piles has complementary recesses at intervals.

2. The jackup oil rig of claim 1, further comprising:

a plurality of collars fixed to the hull, wherein at least one of the plurality of collars is slidably attached to each of the plurality of piles for engaging and gripping, and wherein each of the plurality of collars has one recess fitting with the complementary recesses on the piles; and a plurality of locking means operably engaging the recesses on collars with the complementary recesses on piles, locking the piles with the hull; wherein one collar and one locking means form a piling sub-system; and wherein when the piles slide through the collars, the locking means lock the piles at different positions;

thereby by locking the piles to the hull at different positions, the piles are driven into the seabed or extracted from the seabed by jacking up the hull or jacking down the hull respectively by the jackup modules.

3. The jackup oil rig of claim 2, wherein the locking means is a pin.

4. The jackup oil rig of claim 2, wherein the plurality of piles are driven into the seabed simultaneously.

5. The jackup oil rig of claim 2, wherein the plurality of piles are driven into the seabed one by one.

6. The jackup oil rig of claim 2, wherein the plurality of piles are extracted from the seabed simultaneously.

7. The jackup oil rig of claim 2, wherein the plurality of piles are extracted from the seabed one by one.

* * * * *